US008109119B2

(12) United States Patent
Ahn et al.

(10) Patent No.: US 8,109,119 B2
(45) **Date of Patent: *Feb. 7, 2012**

(54) STEAM GENERATING DEVICE AND WASHING MACHINE HAVING THE SAME

(75) Inventors: In Geun Ahn, Changwon-si (KR); Kyu Won Lee, Busan (KR); Seong Il Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 110 days.

This patent is subject to a terminal disclaimer.

(21) Appl. No.: 11/819,482

(22) Filed: Jun. 27, 2007

(65) Prior Publication Data

US 2008/0011022 A1 Jan. 17, 2008

(30) Foreign Application Priority Data

Jun. 27, 2006 (KR) ..... 10-2006-0058060

(51) Int. Cl.
*D06F 37/00* (2006.01)
*F22B 1/28* (2006.01)

(52) U.S. Cl. ..... 68/5 R; 68/3 R; 68/15; 68/207; 68/222; 34/595

(58) Field of Classification Search ..... 68/5 C, 68/5 R, 3 R, 222, 15, 207; 8/149.1, 149.2, 8/149.3; 34/595
See application file for complete search history.

(56) References Cited

U.S. PATENT DOCUMENTS

2004/0187527 A1* 9/2004 Kim et al. ..... 68/5 C
2005/0034489 A1* 2/2005 Oh et al. ..... 68/5 C
2005/0262644 A1* 12/2005 Oak et al. ..... 8/158
2006/0016020 A1* 1/2006 Park ..... 8/158

FOREIGN PATENT DOCUMENTS

EP 1813704 A1 1/2007
EP 1795644 A1 6/2007
JP 6193807 A 7/1994
KR 1020050108788 * 11/2005

OTHER PUBLICATIONS

Machine Translation Korean Patent Application Publication No. KR 1020050108788 to Kim, Nov. 2005.*

* cited by examiner

*Primary Examiner* — Michael Barr
*Assistant Examiner* — Benjamin Osterhout
(74) *Attorney, Agent, or Firm* — McKenna Long & Aldridge LLP

(57) ABSTRACT

A steam generating device and a washing machine having the same are disclosed. The steam generating device includes a lower housing, which contains water, in which a heater is arranged, and which has a vertical length longer than a horizontal length, an upper housing including a steam chamber for containing steam generated as the water is heated, a water level sensor for sensing a water level of the water chamber, and a receptacle for covering the water level sensor, the receptacle including an opening for allowing water to be introduced into the receptacle. In accordance with this configuration, it is possible to easily install the steam generating device, to achieve a superior performance, to prevent the water level sensor from malfunctioning, and to prevent spots from being formed on laundry.

18 Claims, 10 Drawing Sheets

STEAM GENERATING DEVICE AND WASHING MACHINE HAVING THE SAME

This application claims the benefit of Korean Patent Application No. 10-2006-0058060, filed on Jun. 27, 2006, which is hereby incorporated by reference as if fully set forth herein.

BACKGROUND OF THE INVENTION

1. Field of the Invention

The present invention relates to a steam generating device and a washing machine having the same, and more particularly to a steam generating device which can easily generate steam to be supplied to a washing machine, can be easily installed, and can prevent malfunction of a water level sensor, and a washing machine having the steam generating device.

2. Discussion of the Related Art

Generally, washing machines are classified into a pulsator type, in which a washing operation is carried out using a flow of water generated in accordance with the rotation of a pulsator, and a drum type, in which a washing operation is carried out using the heads of wash water and laundry falling down in a horizontally-installed drum and frictional force generated between the drum and the laundry during rotation of the drum.

Recently, a washing machine, in particular, a drum washing machine, which has a function capable of washing laundry using steam, has been proposed. When steam is used in a washing operation, as in such a washing machine, it is possible to reduce the consumption of water and electricity, to achieve an enhancement in washing performance, to remove creases and odor, and to prevent generation of static electricity.

A general drum washing machine using steam will be described hereinafter with reference to FIG. 8.

The drum washing machine includes a cabinet 10 forming an appearance of the washing machine, a cylindrical tub 20 horizontally supported by the cabinet 10 in the interior of the cabinet 10, to store wash water, a drum 30 rotatably installed in the tub 20, and a drive motor (not shown) for driving the drum 30.

An inlet 13 is formed at a front side of the cabinet 10. The inlet 13 communicates with the interior of the drum 30 so that laundry can be put into or taken out of the drum 30 through the inlet 13. A door 11 is mounted to the inlet 13, to open or close the inlet 13.

Water supply valves 15 are provided at one side of the drum washing machine. The water supply valves 15 are connected to external water pipes (not shown), respectively, so as to supply water to the tub 20. The water valves 15 are connected to a detergent box 27 via a hot water pipe 25*a* and a cold water pipe 26, respectively.

The drum washing machine also includes a steam generating device 50 for supplying steam to the drum 30. A water supply hose 25 and a steam hose 53 are connected to the steam generating device 50. The water supply hose 25 supplies water to the steam generating device 50, whereas the steam hose 53 supplies steam generated from the steam generating device 50 to the drum 30.

The configuration of the steam generating device 50 will be described in more detail with reference to FIGS. 9 and 10.

The steam generating device 50 includes a case 80. The case 80 includes a lower housing 81 forming an appearance of the steam generating device 50 and an upper housing 82 coupled to an upper end of the lower housing 81. A space for storing water is defined in the lower housing 81. The steam generating device 50 also includes a heater 55 for heating water stored in the case 80.

A water supply port 52*b* is formed at one side of the housing 82. The water supply port 52*b* is connected to the water supply hose 25, to introduce water from the water support hose 25 into the steam generating device 50. A steam discharge port 52*a* is formed at the other side of the housing 82. The steam discharge port 52*a* is connected to the steam hose 53, to supply steam from the steam hose 53 to the drum 20.

A water level sensor 60 and a temperature sensor 57 are installed at one side of the upper housing 82. The water level sensor 60 senses the level of water stored in the steam generating device 50. The temperature sensor 57 measures the temperature of water heated by the heater 55 and the temperature of steam generated in accordance with the heating of the water.

The water level sensor 60 includes a receptacle housing 61 forming an appearance of the water level sensor 60. The receptacle housing 61 is fixedly mounted to the steam generating device 50. The water level sensor 60 also includes electrodes arranged in the receptacle housing 61 such that they extend downwardly, to sense the level of water stored in the steam generating device 50.

The electrodes comprise at least a common electrode 62 functioning as a reference electrode for sensing a water level, a low-water-level electrode 63 for sensing a low water level, and a high-water-level electrode 64 for sensing a high water level.

When water boils, air bubbles may be abruptly generated, and may be attached to the electrodes 62, 63, and 64. In this case, the electrodes 62, 63, and 64 may malfunction. Furthermore, it is difficult to completely prevent generation of vibration during operation of the washing machine. For this reason, the steam generating device 50 may also vibrate during operation of the washing machine, so that the water stored in the steam generating device 50 may roll.

In order to prevent the water level sensor 60 from malfunctioning due to the above-mentioned factors, a receptacle 70 is provided. The receptacle 70 is configured to enclose the electrodes 62, 63, and 64. The receptacle 70 also has an opening 70*s*.

As shown in FIG. 9, the receptacle 70 includes an upper receptacle 71 extending downwardly from the upper housing 82, to protect an upper portion of the water level sensor 70, and a lower receptacle 73 extending upwardly from the lower housing 81, to protect a lower portion of the water level sensor 70. Each of the receptacles 71 and 73 has a chamber structure.

The above-mentioned conventional steam generating device and the washing machine equipped with the same have the following problems.

Since the conventional steam generating device has a substantially rectangular shape having a small height L1 and a large width L2, as shown in FIG. 11, it is difficult to install the steam generating device 50 in the washing machine.

In detail, this is because, although the steam generating device 50 is typically installed in an upper portion of the washing machine, namely, between the cabinet 10 and the tub 20, the spacing t between the tub 20 and the steam generating device 50 is relatively small.

In the space defined between the cabinet 10 and tub 20, a valve, hanging springs, etc. are also installed. For this reason, the space for installing the steam generating device 50 may be insufficient. As a result, it is difficult to install the steam generating device 50. Furthermore, the steam generating device 50 may interfere with other elements of the washing machine when the washing machine is moved, so that the steam generating device 50 may be damaged.

Since the spacing between the cabinet 10 and the tub 20 is relatively small, they may strike against each other due to vibrations generated during operation of the washing machine. As a result, the cabinet 10 and tub 20 may be damaged. The repair or replacement of the damaged elements is also difficult.

In addition, it is required to achieve improvements in the amount of water used, energy efficiency, steam generating time, security, etc.

SUMMARY OF THE INVENTION

Accordingly, the present invention is directed to a steam generating device and a washing machine having the same that substantially obviate one or more problems due to limitations and disadvantages of the related art.

An object of the present invention is to provide a steam generating device, which can be more easily installed, and can prevent malfunction of a water level sensor, and a washing machine having the steam generating device.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a steam generating device comprising: a lower housing for containing water, the lower housing receiving a heater and having a vertical length longer than a horizontal length; an upper housing including a steam chamber for containing steam generated as the water is heated; a water level sensor for sensing a water level of the water chamber; and a receptacle for covering the water level sensor, the receptacle including an opening for allowing water to be introduced into the receptacle.

The steam generating device may further comprise a barrier rib arranged at one side of the receptacle, to remove air bubbles introduced into the receptacle at the side of the receptacle.

The barrier rib may be arranged in a flow path of the air bubbles introduced into the receptacle.

The steam generating device may further comprise a vertical rib arranged to intersect the barrier rib while being spaced apart from the barrier rib.

More preferably, the steam chamber has a horizontal length longer than a horizontal length of the water chamber.

The steam generating device may further comprise a chamber arranged at the other side of the receptacle, to remove air bubbles into the receptacle at the other side of the receptacle.

The receptacle may include a long barrier wall arranged in a longitudinal direction of the water level sensor, and short barrier walls arranged at opposite sides of the long barrier wall, respectively, and connected to the upper housing.

Each of the short barrier walls may be formed with an opening for allowing water to be introduced into the receptacle.

At least one of the short barrier walls may be provided with a vertical rib for removing air bubbles introduced into the receptacle.

Preferably, the vertical rib is arranged to intersect the barrier rib while being spaced apart from the barrier rib.

More preferably, one of the short barrier walls may form a chamber for removing air bubbles introduced into the receptacle.

In another aspect of the present invention, a washing machine comprises: a body; a tub installed in the body; a drum rotatably installed in the tub; and a steam generating device including a lower housing for containing water, the lower housing receiving a heater and having a vertical length longer than a horizontal length, an upper housing including a steam chamber for containing steam generated as the water is heated, a water level sensor for sensing a water level of the water chamber, and a receptacle for covering the water level sensor, the receptacle including an opening for allowing water to be introduced into the receptacle.

In the washing machine, the receptacle may include a long barrier wall arranged in a longitudinal direction of the water level sensor, and short barrier walls arranged at opposite sides of the long barrier wall, respectively, and connected to the upper housing.

Each of the short barrier walls may be formed with an opening for allowing water to be introduced into the receptacle.

At least one of the short barrier walls may be provided with a vertical rib for removing air bubbles introduced into the receptacle.

The vertical rib may be arranged to intersect the barrier rib while being spaced apart from the barrier rib.

More preferably, one of the short barrier walls forms a chamber for removing air bubbles introduced into the receptacle.

Preferably, the steam chamber has a horizontal length longer than a horizontal length of the water chamber.

The washing machine may further comprise a separator for separating a flow path of steam outwardly discharged, from other regions.

The washing machine may further comprise a reverse flow preventing member arranged in at least one of a water supply line and a steam supply line, to prevent water or steam from flowing reversely.

The washing machine may further comprise a safety valve for outwardly discharging steam from a steam supply line when an excessive pressure is applied to the steam supply line.

In accordance with the above-described configuration, it is possible to easily install the steam generating device, and to avoid accumulation of foreign matter, and thus to prevent the water level sensor from malfunctioning.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

The present invention now will be described more fully hereinafter with reference to the accompanying figures, in which embodiments of the invention are shown. Wherever possible, the same reference numbers will be used throughout the drawings to refer to the same or like parts, and no repeated description thereof will be given.

Figure 1:
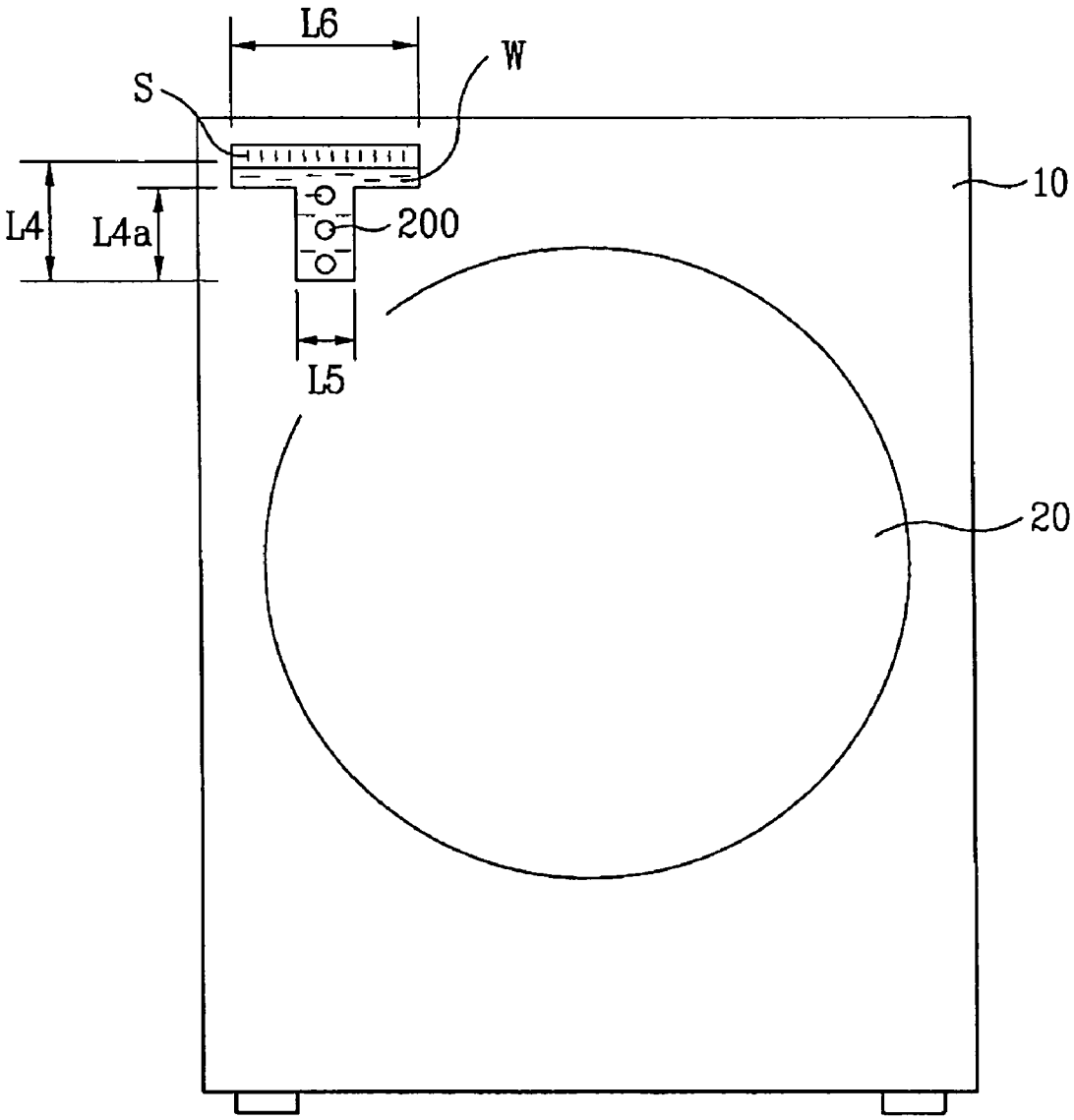
FIG. 1 is a schematic view illustrating an installed state of a steam generating device according to the present invention.
Figure 2:
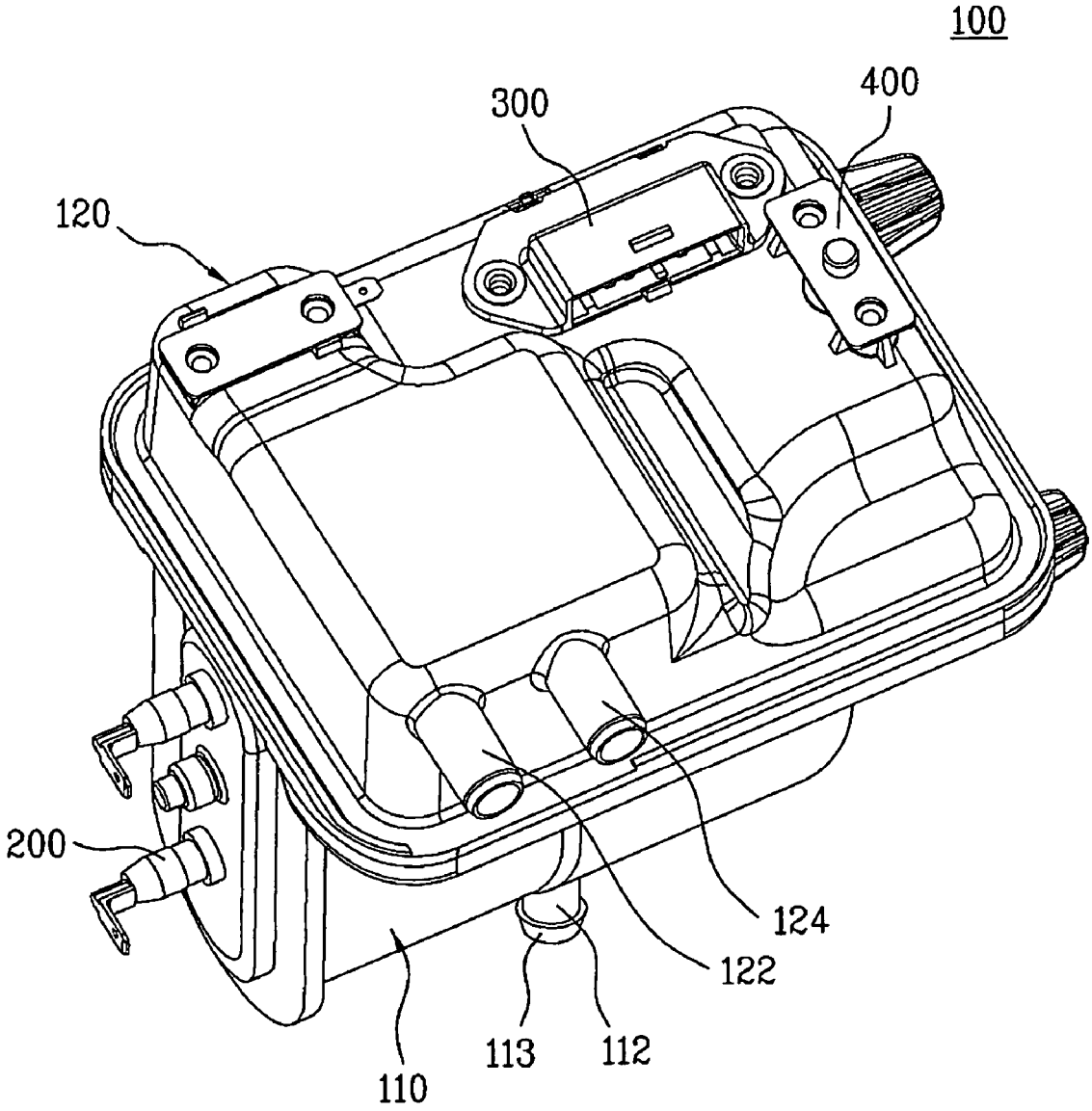
FIG. 2 is a perspective view illustrating the steam generating device shown in FIG. 1.
Figure 3:
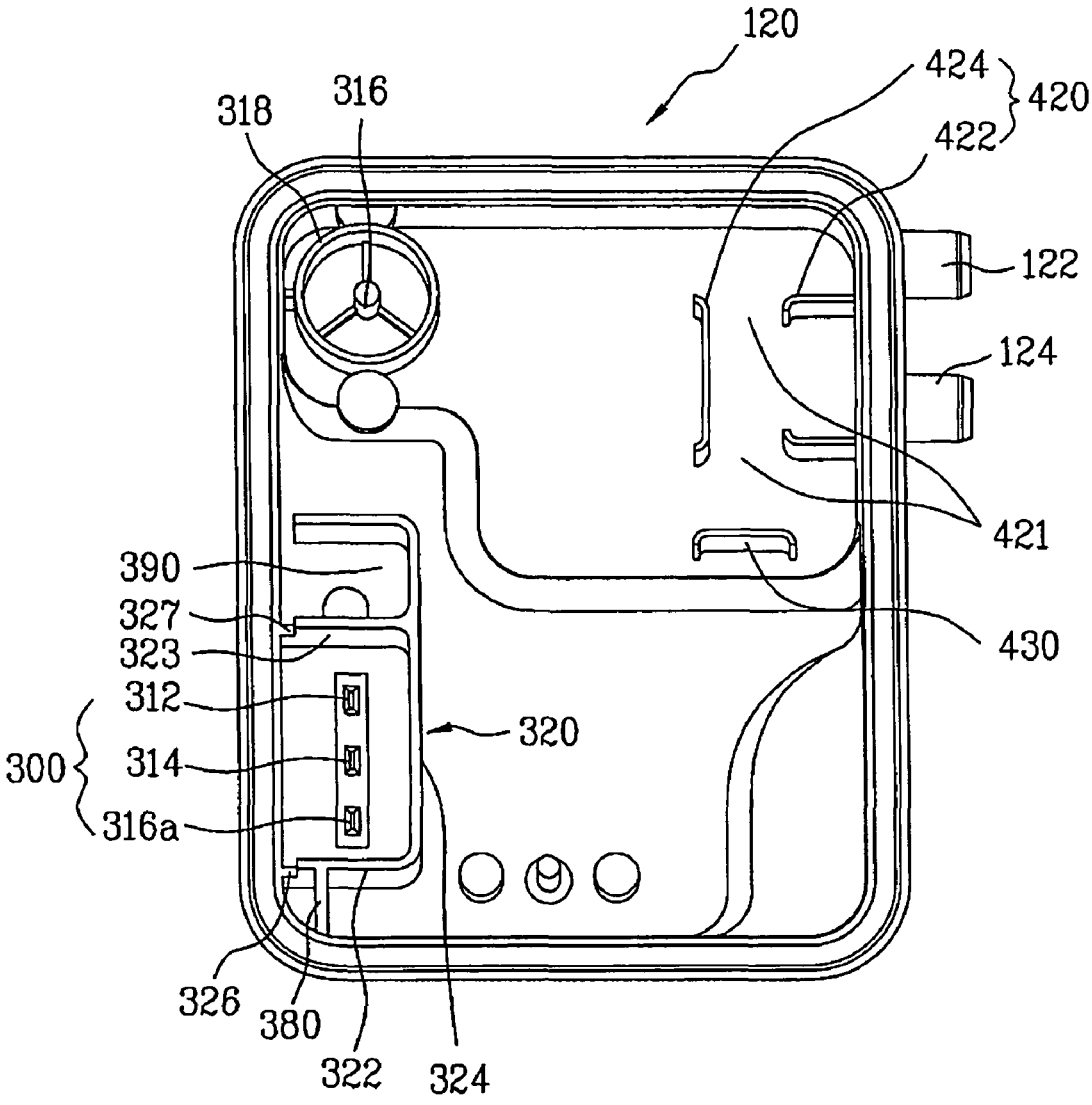
FIG. 3 is a bottom view illustrating an upper housing shown in FIG. 2.
Figure 4:
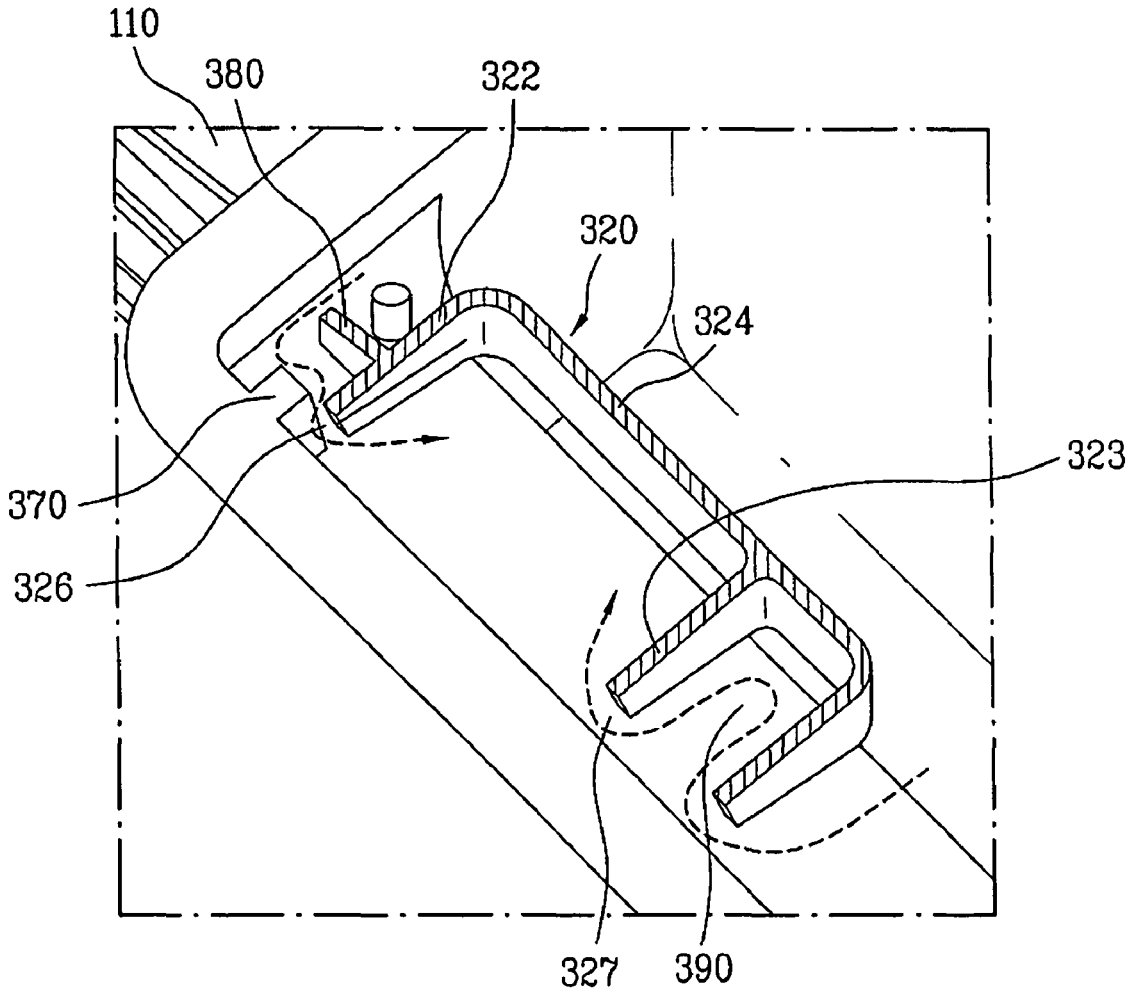
FIG. 4 is a perspective view illustrating a part of a lower housing shown in FIG. 2.

FIG. 1 is a schematic view illustrating an installed state of a steam generating device according to the present invention. FIG. 2 is a perspective view illustrating the steam generating device shown in FIG. 1. FIG. 3 is a bottom view illustrating an upper housing shown in FIG. 2. FIG. 4 is a perspective view illustrating a part of a lower housing shown in FIG. 2.

Hereinafter, the principle of the steam generating device according to the present invention will be described with reference to FIGS. 1 and 2.

The steam generating device 100 of the present invention includes a lower housing 110 defined with a water chamber W, in which a heater 200 for heating water is installed. The steam generating device 100 also includes an upper housing 120 defined with a steam chamber S arranged over the water chamber W. The steam chamber S contains steam generated in accordance with the heating of water.

Water contained in the water chamber W is heated by the heater 200, thereby generating steam. The generated steam is temporarily contained in the steam chamber S, and is then outwardly discharged from the steam chamber S through a steam discharge port 124 formed at the steam chamber S.

The water chamber W is configured to have a vertical length L4 longer than a horizontal length L5. The heater 200 extends vertically in the water chamber W. As shown in FIG. 1, the vertical length of the water chamber W may substantially correspond to a length L4*a*, namely, the vertical extension length of the heater 200. However, since it is preferred that water be contained in the water chamber W to a level higher than the top of the heater 200, it is assumed, in the following description, that the vertical length of the water chamber W corresponds to "L4".

However, there is no contradiction or problem caused by this assumption because the difference between "L4" and "L4*a*" is relatively small, and the amount of water contained in the water chamber W to the level L4*a* is a main portion of the total amount of water contained in the water chamber W. For the same reason, it is also assumed that the horizontal length of the water chamber W corresponds to the width of a portion of the water chamber W, in which the main portion of the total water amount is contained, namely, "L5".

Thus, it is possible to reduce the horizontal length L5 of the water chamber W, as compared to conventional cases, while containing the same amount of water. Accordingly, it is possible to reduce the interference between the tub 20 and the steam generating device 100. Through an experiment, it was found that, since the contact area between the steam and the water is large in accordance with the present invention, it is possible to reduce the amount of water used to generate the same amount of steam as the conventional cases, and the steam generating time, and thus to reduce the size of the steam generating device 100.

Meanwhile, it is preferred that the horizontal length L6 of the steam chamber S be relatively longer than the horizontal length L5 of the water chamber W. That is, although it is possible to reduce the horizontal length L6 of the steam chamber S, as compared to the conventional cases, it is preferred that the horizontal length L6 of the steam chamber S be equal to or slightly shorter than those of the conventional cases. This is because a water supply port and a steam discharge port are typically formed at the steam chamber S, and a water level sensor, a temperature sensor, etc. are also mounted to the steam chamber S.

On the other hand, the vertical length L4 of the water chamber W may be relatively longer than the horizontal length L5. As shown in FIG. 1, it is also preferred that the water chamber W be arranged substantially at a central portion of the steam chamber S.

Hereinafter, a concrete embodiment of the steam generating device 100 will be described with reference to FIG. 2.

As described above, the steam generating device 100 includes the lower housing 110 and upper housing 120. The upper housing 120 has a horizontal length longer than the horizontal length of the lower housing 110.

Figure 5:
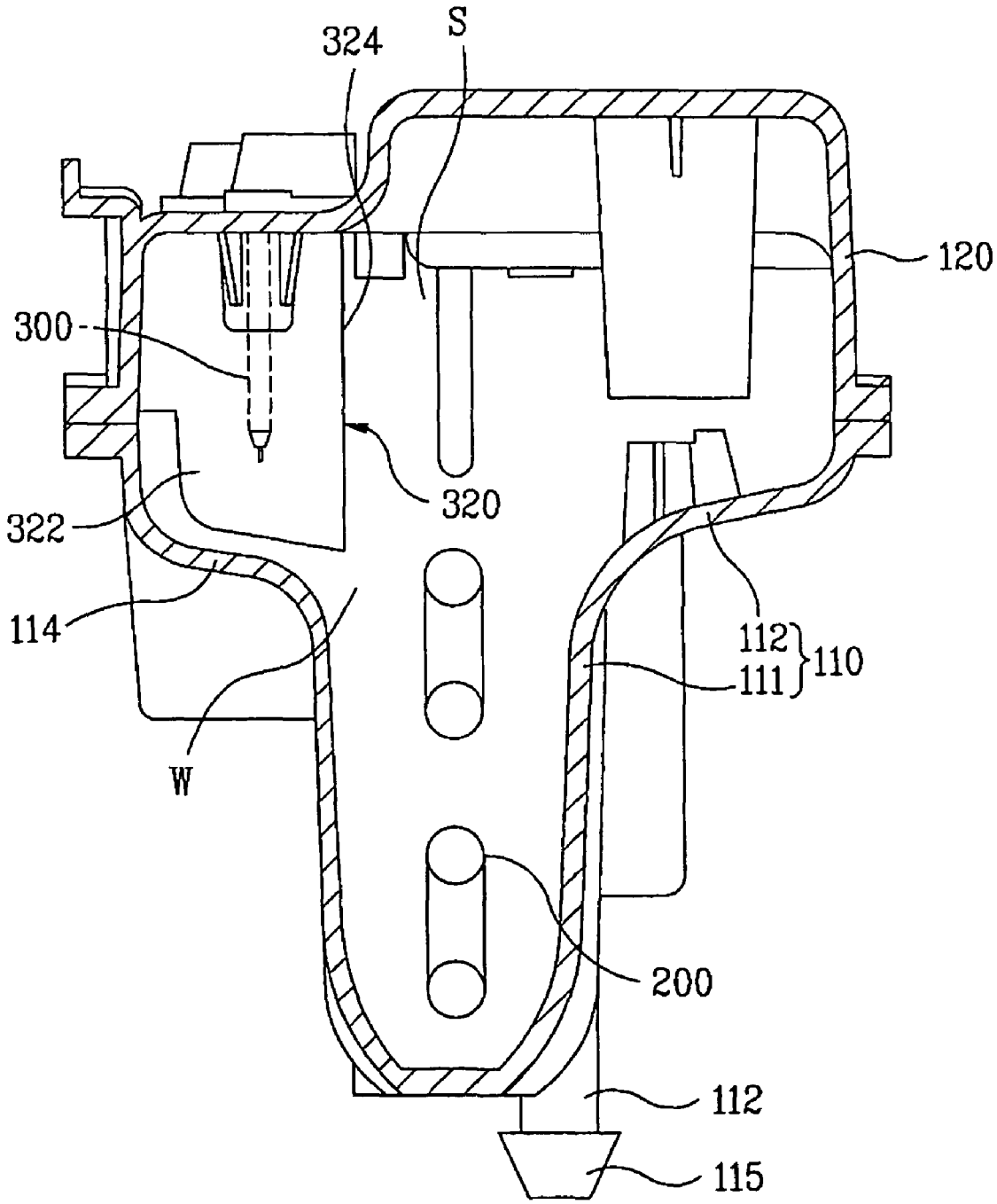
FIG. 5 is a sectional view corresponding to FIG. 4.

As shown in FIG. 5, the lower housing 110 includes a portion in which the heater 200 is mounted, which contains a main portion of the total amount of water in the water chamber W, and which has a vertical length longer than a horizontal length. This portion will be referred to as a "main portion 111", for the convenience of description. The lower housing 110 also includes portions extending from the main portion 111 in opposite lateral directions, and connected to the upper housing 120. These portions will be referred to as "connecting portions 112 and 114", for the convenience of description.

It is preferred that the main portion of water in the water chamber W be present in the main portion 111 of the lower housing 110, and the remaining small portion of water in the water chamber W be present in the connecting portions 112 and 114. It is also preferred that the connecting portions 112 and 114 be inclined toward the main portion 111. In accordance with this structure, it is possible to prevent foreign matter such as lime from being deposited over electrodes of a water level sensor 300 arranged in the connecting portions 112 and 114.

Since the water chamber W is narrow in accordance with the present invention, the pressure and temperature of steam generated in the water chamber W is relatively high, as compared to conventional cases. To this end, it is preferred that the lower and upper housings 110 and 120 be made of a material capable of withstanding high pressure. In this regard, it is preferred that the lower and upper housings 110 and 120 be connected using vibration fusing, rather than thermal fusing.

Hereinafter, the upper housing 120 defined with the steam chamber S will be described with reference to FIGS. 3 to 5.

The water supply port 122 and steam discharge port 124 are formed at the upper housing 120. Preferably, the housing 120 has a protruded portion, to form the water supply port 122 and steam discharge port 124 at the protruded portion.

The water level sensor 300 is arranged in the upper housing 120. A temperature sensor 400 is also arranged in the upper housing 120. It is preferred that the water level sensor 300 be arranged at a position spaced apart from the water supply port 122 by a certain distance, namely, at a position misaligned from a water supply direction of the water supply port 122.

In this case, it is possible to prevent water splashed while being discharged from the water supply port 122 from coming into contact with the water level sensor 300, and thus to prevent the water level sensor 300 from malfunctioning.

It is also preferred that the water level sensor 300 be arranged adjacent to an inner wall surface of the upper housing 120, namely, be arranged over the connecting portion 114 of the lower housing 110, rather than the main portion 111. In other words, it is preferred that the water level sensor 300 be arranged to be spaced apart from the main portion 111 of the water chamber W by a certain distance.

In this case, it is possible to effectively prevent water splashed and air bubbles generated in an initial heating stage of the heater 200 from coming into direct contact with the water level sensor 300, and thus to effectively prevent the water level sensor 300 from malfunctioning due to the splashed water and air bubbles.

Meanwhile, a receptacle 320 is mounted to the upper housing 120, to protect the water level sensor 300. The receptacle 320 is provided with openings 326 and 327 for allowing water to be introduced into the receptacle 320.

As shown in FIG. 4, a barrier rib 370 is protruded from one side of the receptacle 320, in order to remove air bubbles introduced into the receptacle 320 through the opening 326. A chamber 390 is also defined in the receptacle 320, opposite to the barrier rib 370, in order to remove air bubbles introduced into the receptacle 320 through the opening 327.

It is preferred that the barrier rib 370 be protruded into a flow path of air bubbles flowing toward the opening 326 of the receptacle 320.

A vertical rib 380 may also be provided at one side of the receptacle 320. The vertical rib 380 is protruded such that it intersects the barrier rib 370 while being spaced apart from the barrier rib 370 by a certain distance.

When the barrier rib 370 is arranged to intersect the vertical rib 380, as described above, a curved flow path is defined in the vicinity of the opening 326, through which air bubbles flow. Accordingly, air bubbles disappear gradually while passing through the flow path extending to the opening 326.

The structure for removing air bubbles flowing toward the receptacle 320 will be described in detail with reference to FIGS. 3 and 4. For the convenience of description, FIG. 4 illustrates a part of the receptacle 320 formed at the upper housing 120. Also, in FIG. 4, the phantom lines and arrows indicate flows of air bubbles.

As shown in the drawings, the receptacle 320 may include barrier walls in accordance with the present invention.

In this case, it is preferred that the inner wall of the steam generating device 100 constitute a part of the barrier walls of the receptacle 320.

For example, the barrier walls of the receptacle 320 may include a long barrier wall 324 arranged in parallel to the water level sensor 300, to form a longitudinal surface of the receptacle 320, and a pair of short barrier walls 322 and 323 each connected, at one end thereof, to the long barrier wall 324, and connected, at the other end thereof, to the inner wall surface of the upper housing 120 such that the short barrier walls 322 and 323 form opposite lateral surfaces of the receptacle 320, respectively.

Preferably, the long barrier wall 324 is arranged over the connecting portion 114 of the lower housing 110. In particular, it is preferred that the long barrier wall 324 be arranged over a wall portion of the main portion 111 extending along the boundary between the main portion 111 and the connecting portion 114 of the water chamber W (substantially defined in the lower housing 110).

The first short barrier wall 322 may be arranged at one side of the heater 200, whereas the second short barrier wall 323 may be arranged at the other side of the heater 200.

Preferably, the first opening 326 is formed through the first short barrier wall 322 at the other end of the first short barrier wall 322. Also, the second opening 327 is preferably formed through the second short barrier wall 323 at the other end of the second short barrier wall 323. The vertical rib 380 is protruded from the first short barrier wall 322 in a direction perpendicular to the first short barrier wall 322.

In this case, the barrier rib 370 is protruded from the inner wall surface of the upper housing 120 such that the barrier rib 370 intersects the vertical rib 380 while being spaced apart from the vertical rib 380 by a certain distance.

That is, as shown in FIG. 4, the barrier rib 370 is arranged at the side of the first opening 326, together with the vertical rib 380, to define a curved flow path of air bubbles. Accordingly, air bubbles disappear while passing through the curved flow path. As a result, there is no air bubble introduced into the first opening 326.

Meanwhile, as described above, the chamber 390 may also be formed outside the second short barrier wall 323, to remove air bubbles introduced into the second opening 327.

Thus, at the side of the first short barrier wall 322, the curved flow path is formed in accordance with the formation of the barrier rib 370 and vertical rib 380 such that air bubbles are removed while passing through the curved flow path. Also, at the side of the second short barrier wall 323, the chamber 390 is formed such that air bubbles are removed when they are introduced into the chamber 390, before being introduced into the second opening 327.

Accordingly, it is possible to prevent air bubbles from being introduced into the receptacle 320 in opposite directions by the barrier rib 370 and chamber 390, and thus to completely prevent the water level sensor 300 from malfunctioning due to air bubbles.

Meanwhile, the water level sensor 300 includes a common electrode 312, a low-water-level electrode 314, and a high-water-level electrode 316. The high-water-level electrode 316 is spaced apart from the low-water-level electrode 314 by a certain distance.

For the water level sensor 300, a standard product, which includes a common electrode 312, a low-water-level electrode 314, and a high-water-level electrode 316*a*, is commercially available. Accordingly, a general water level sensor assembly, which has such a configuration, may be used in the present invention, without any modification. In this case, however, it is preferred that a separate high-water-level electrode 316 be used, in place of the high-water-level electrode 316*a* of the general water level sensor assembly.

In this case, It is also preferred that a high-water-level electrode receiver 318 is provided at a position spaced apart from the water level sensor 300, to receive the high-water-level electrode 316. For example, the high-water-level electrode receiver 318 may have a cylindrical barrier wall structure. In accordance with the provision of the high-water-level electrode receiver 318, it is possible to prevent the water level sensor 300 from malfunctioning due to water drops attached between the low-water-level electrode 314 and the high-water-level electrode 316.

As described above, the steam discharge port 124 is formed at the upper housing 120, to discharge steam. A separator 420 is arranged at the steam discharge port 124, in order to separate the flow path of steam discharged out of the steam discharge port 124 from other regions.

Water and air bubbles are severely splashed when the water is heated in the water chamber W, in particular, in an initial heating stage. The separator 420 prevents the splashed water from being introduced into the drum through the steam discharge port 124. When the splashed water is introduced into the drum, spots may be formed on the laundry. The separator 420 avoids such a phenomenon.

The separator 420 may have various structures, as long as it has a hole communicating with the steam discharge port 124 therein, to receive steam from the steam discharge port 124. For example, the separator 420 may have a barrier wall structure. In this case, it is preferred that the barrier wall structure has an opening 421 to receive steam. In particular, it is preferred that the barrier wall structure have a plurality of vertically-arranged openings 421 spaced apart from the steam discharge port 124 by a certain distance.

The barrier wall structure includes a first barrier wall 424 substantially facing the steam discharge port 124, and a second barrier wall 422 spaced apart from the first barrier wall 424 while defining the opening 421. Preferably, the first barrier wall 424 is arranged over the connecting portion 112 of the water chamber W, rather than the main portion 111 of the water chamber W.

An auxiliary separator 430, for example, a barrier wall, may be arranged outside the separator 420. Preferably, the barrier wall of the auxiliary separator 430 is arranged adjacent to the opening 421 of the separator 420, without contacting the inner wall surface of the steam generating device 100.

Meanwhile, water is supplied to the water chamber W via a water supply line including, for example, the water supply hose or water supply port 122. Steam from the steam chamber S is discharged into the drum via a steam discharge line including, for example, the steam discharge port 124 and steam hose.

Preferably, a reverse flow preventing member is arranged in at least one of the water supply line and steam discharge line, to prevent water and steam from flowing reversely. For the reverse flow preventing member, various members may be used, as long as they have a reverse flow preventing function. For example, a one-way valve may be used for the reverse flow preventing member.

Figure 6:
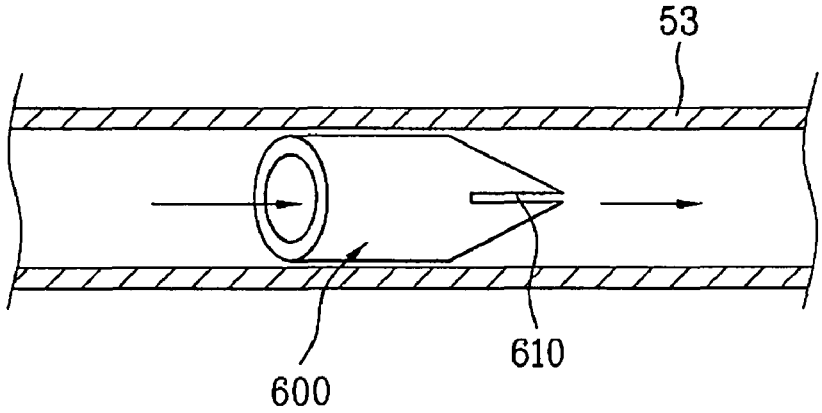
FIG. 6 is a schematic view illustrating an installed state of a reverse flow preventing member according to the present invention.

However, it is preferred that, for the reverse flow preventing member, a nozzle-shaped flexible member 600 be used, and a slit 610 be formed at a nozzle portion of the flexible member 600, as shown in FIG. 6, because the reverse flow preventing member is arranged in the water supply hose, water supply port 122, water discharge port 124, or steam discharge hose, which has a relatively-small diameter.

Figure 7:
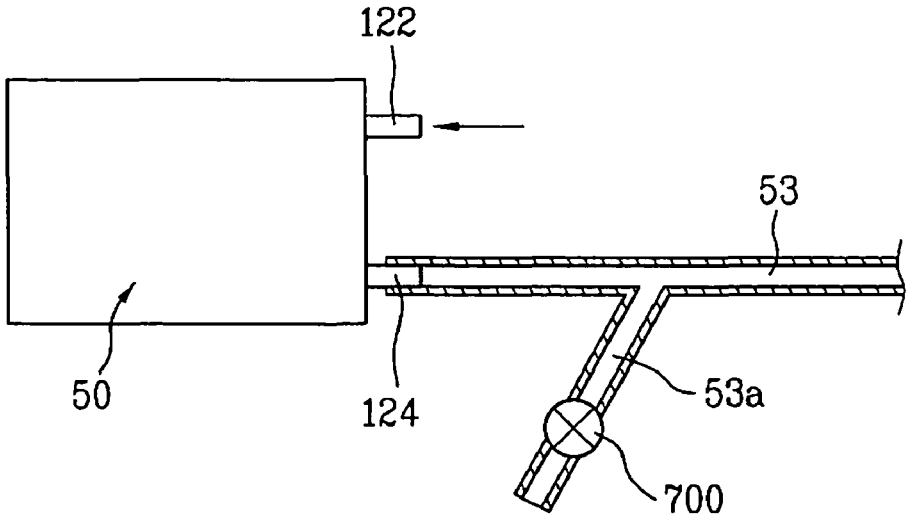
FIG. 7 is a schematic view illustrating an installed state of a safety valve according to the present invention.
Figure 8:
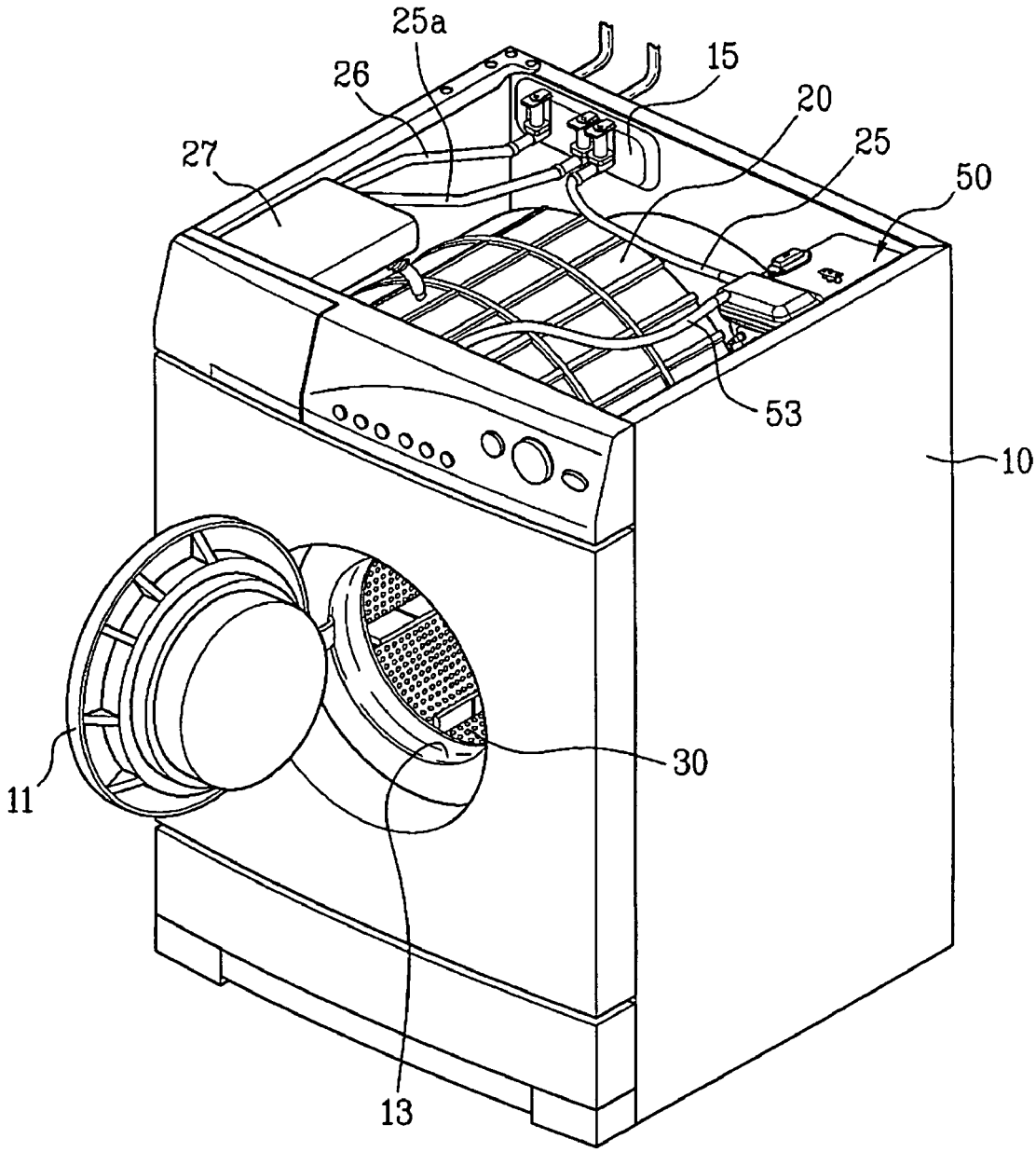
FIG. 8 is a perspective view illustrating a conventional drum washing machine.
Figure 9:
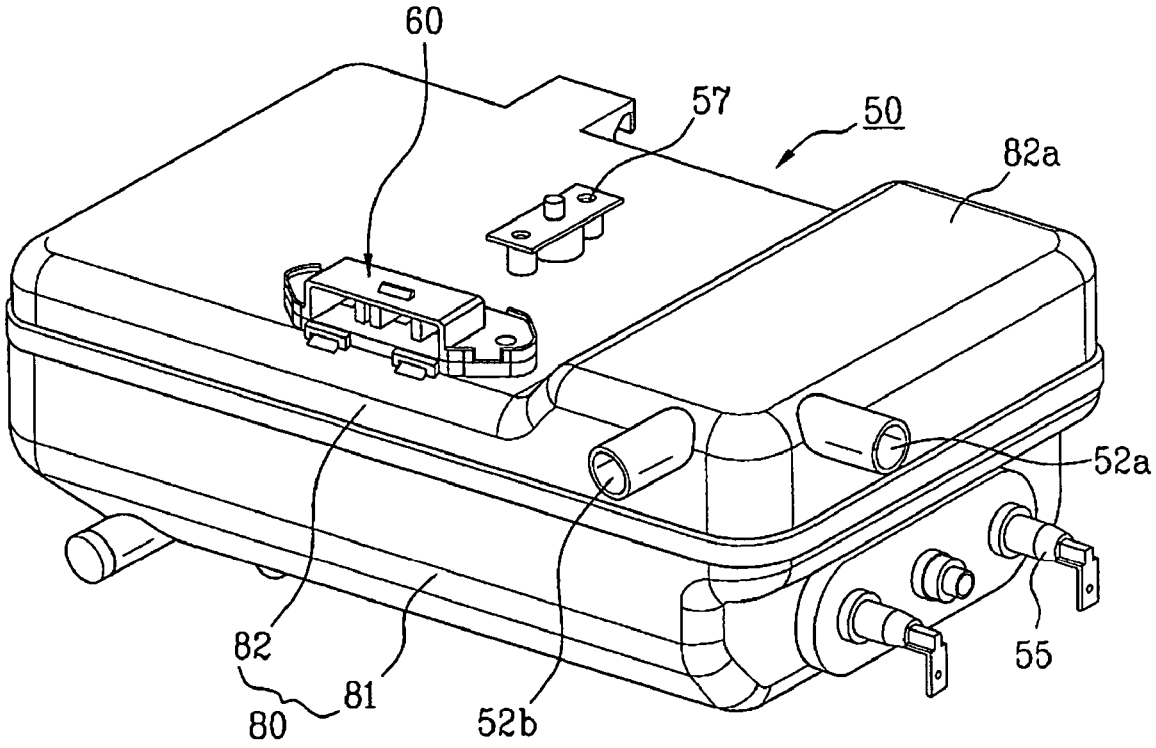
FIG. 9 Related Art
FIG. 9 is a perspective view illustrating a steam generating device shown in FIG. 8.
Figure 10:
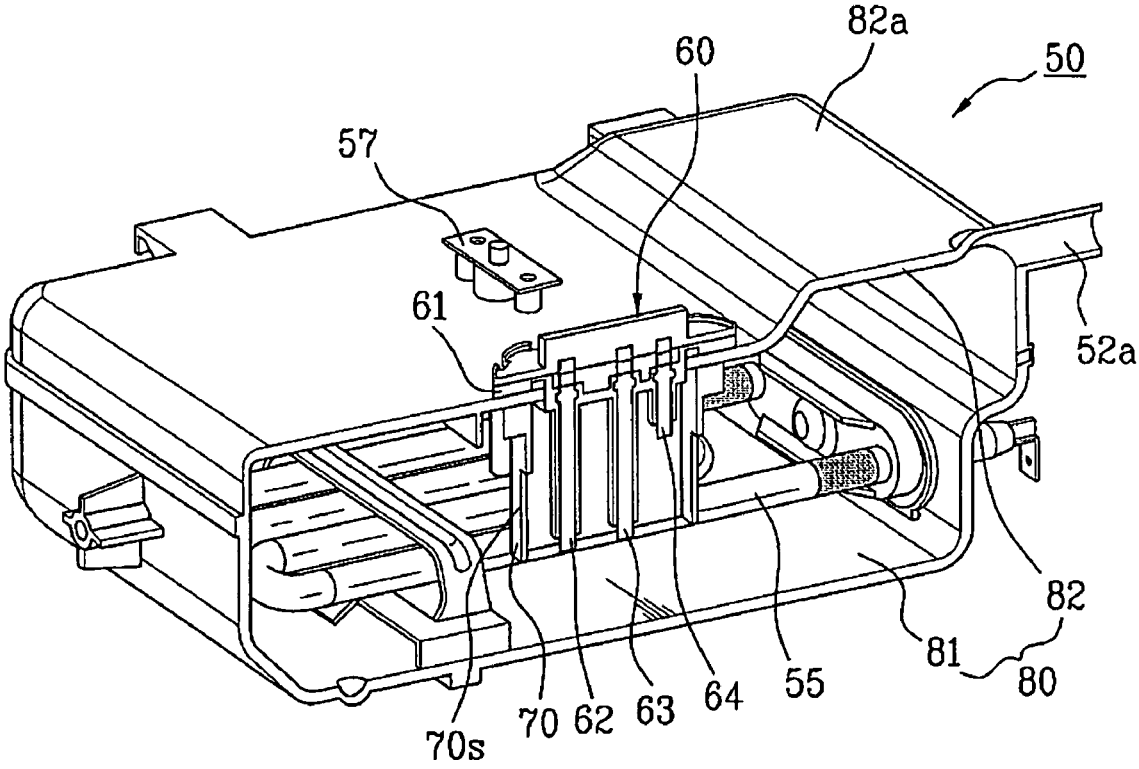
FIG. 10 Related Art
FIG. 10 is a partially-broken perspective view illustrating the steam generating device shown in FIG. 8.
Figure 11:
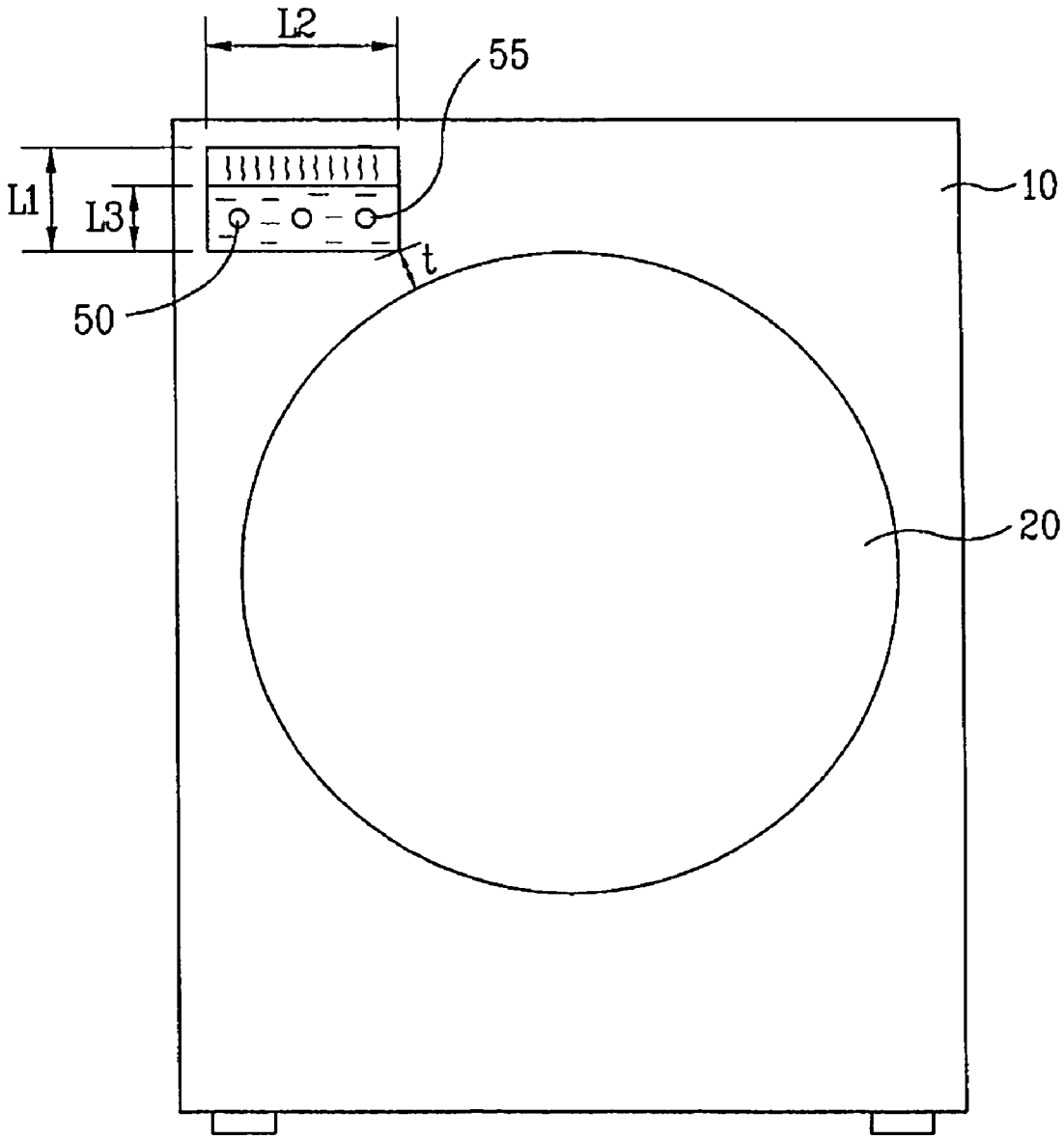
FIG. 11 Related Art
FIG. 11 is a schematic view illustrating an installed state of the steam generating device shown in FIG. 8.

Meanwhile, as shown in FIG. 7, a safety valve 700 may be arranged at a certain position of the steam discharge line. The safety valve 700 is automatically opened when the pressure of steam passing through the steam discharge line is higher than a predetermined level. The steam hose, which is designated by reference numeral "53" in FIG. 7, may be branched to form a branch pipe 53*a*, and the safety valve 700 may be arranged in the branch pipe 53*a*.

When no steam is supplied to the drum due to a problem occurring in the steam supply line, an excessive pressure is applied to the steam supply line. In this case, the safety valve 700 is automatically opened to outwardly discharge steam from the steam supply line.

A draining member 115 is provided at the water chamber W, as shown in FIG. 5, to outwardly drain water from the water chamber W. An opening/closing member 113 is arranged at the draining member 115, to open or close the draining member 115.

That is, it is possible to outwardly drain water from the water chamber W by opening the opening/closing member 113. As the steam generating device 100 is continuously used for a prolonged period of time, foreign matter such as lime is accumulated in the steam generating device 100. In this case, the draining member 115 is opened to outwardly drain water from the water chamber W, and thus to discharge the accumulated foreign matter, together with the water. Accordingly, it is possible to avoid the accumulation of foreign matter.

The opening/closing member 113 may be a drain cap which can be manually opened or closed by the user or operator. Alternatively, the opening/closing member 113 is configured to be automatically opened or closed. For example, a solenoid valve may be used. Also, the opening/closing member 113 may be configured using a siphon principle.

The inner structure of the steam generating device according to the present invention including the barrier walls for the water level sensor, auxiliary barrier wall, separator, reverse flow preventing member, opening/closing member, etc. may be applied to general steam generating devices.

The steam generating device having the above-described configuration according to the present invention and the washing machine having the same provide the following effects.

First, it is possible to more easily install the steam generating device because the water chamber of the steam generating device has a vertical length shorter than a horizontal length.

Second, it is possible to enhance the performances of the steam generating device and washing machine because a desired amount of steam can be generated within a reduced time, using a reduced amount of water.

Third, an improvement in security is achieved because it is possible to efficiently prevent water and steam from flowing inversely, and the safety valve operates when an excessive pressure is generated due to a problem occurring in the steam supply line.

Fourth, it is possible to efficiently prevent the water level sensor from malfunctioning because a barrier rib and a chamber are formed at the sides of the short barrier walls of the receptacle, respectively, to remove air bubbles flowing toward the receptacle.

Fifth, it is possible to prevent water present in the steam generating device from entering the drum, and thus to prevent spots from being formed on laundry contained in the drum.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a cabinet which forms an exterior of the washing machine;

a drum rotatably provided in the cabinet; and a steam generating device provided outside of the drum and at an upper portion of the machine to supply steam to the drum, wherein the steam generator comprises:

a water supply line to receive water;

a steam discharge line to discharge steam;

a water level sensor to sense a water level in the steam generating device;

a water chamber to hold the water, the water chamber including a main portion having a vertical length greater than a horizontal length in which a heater is placed and the horizontal length of the main portion is smaller than a horizontal length of any other portion of the water chamber; and a steam chamber to hold the generated steam, wherein the water chamber has a vertical direction length relatively greater than a horizontal direction length and the steam chamber has a horizontal direction length relatively greater than the horizontal length of the main portion of the water chamber and wherein the steam chamber is provided above the water chamber to hold steam generated as the water is heated.

2. The machine according to claim 1, wherein the steam generating device includes a lower housing which defines the water chamber to contain water and a upper housing which defines a steam chamber to contain steam.

3. The machine according to claim 2, wherein the steam chamber has a horizontal length relatively longer than the horizontal length of the water chamber.

4. The machine according to claim 2, wherein the lower housing includes a connecting portion extended to opposite sides of the main portion and secured to the upper housing.

5. The machine according to claim 2, wherein the water level sensor is arranged adjacent to an inner wall of the upper housing.

6. The machine according to claim 4, wherein the water level sensor is arranged over the connecting portion and is horizontally spaced apart from the main portion.

7. The machine according to claim 1, wherein the heater is vertically disposed in the water chamber.

8. The machine according to claim 1, further comprising a receptacle disposed around the water level sensor.

9. The machine according to claim 8, wherein the receptacle includes a second opening configured to allow water flow into the receptacle, and the steam generating device further comprising a chamber to hold the water before entering the second opening.

10. The machine according to claim 8, wherein the receptacle includes a long barrier wall arranged in a longitudinal direction of the water level sensor.

11. The machine according to claim 10, wherein the long barrier wall is spaced apart from the heater by a distance equal to or longer than a distance from the heater to an inner surface of the main portion.

12. The machine according to claim 8, wherein the receptacle includes a first opening arranged vertically to allow water to flow horizontally into the receptacle.

13. The machine according to claim 12, further comprising a barrier rib arranged vertically in front of the first opening to define a horizontally curved flow path for air bubbles and to be vertically parallel with the first opening in order to remove the air bubbles introduced into the receptacle.

14. The machine according to claim 13, further comprising a vertical rib arranged to intersect the barrier rib and spaced apart from the barrier rib to define the flow path.

15. The machine according to claim 14, wherein the vertical rib is configured to define a chamber with the receptacle and inside walls of the upper housing.

16. The machine according to claim 14, wherein the vertical rib is extended from the receptacle.

17. The machine according to 10, wherein the receptacle further includes a plurality of short barrier walls arranged at opposite sides of the long barrier wall.

18. The machine according to claim 17, wherein one of the plurality of short barrier walls is configured to define the first opening.

* * * * *